US009555302B1

(12) United States Patent
Duque

(10) Patent No.: US 9,555,302 B1
(45) Date of Patent: Jan. 31, 2017

(54) PRACTICE DEVICE FOR HITTING GOLF BALLS OFF GROUND

(71) Applicant: Antonio J. Duque, San Antonio, TX (US)

(72) Inventor: Antonio J. Duque, San Antonio, TX (US)

(73) Assignee: Antonio J. Duque, San Antonio, TX (US)

( * ) Notice: Subject to any disclaimer, the term of this patent is extended or adjusted under 35 U.S.C. 154(b) by 0 days.

(21) Appl. No.: 14/878,500

(22) Filed: Oct. 8, 2015

(51) Int. Cl.
*A63B 69/36* (2006.01)

(52) U.S. Cl.
CPC ..... *A63B 69/36* (2013.01); *A63B 2208/0204* (2013.01)

(58) Field of Classification Search
USPC ..... 473/139–149, 257
See application file for complete search history.

(56) References Cited

U.S. PATENT DOCUMENTS 3,837,654 A * 9/1974 Hall ..... A63B 69/0091 473/143
5,121,923 A * 6/1992 D'Allura ..... A63B 69/0091 206/315.1
5,577,964 A * 11/1996 Chen ..... A63B 69/0091 473/145
5,865,683 A * 2/1999 Yang ..... A63B 69/0091 473/139
8,801,528 B1 * 8/2014 Dras ..... A63B 69/0079 473/147
2004/0063509 A1 * 4/2004 Shioda ..... A63B 69/0079 473/139
2011/0306433 A1 * 12/2011 Brantingham ..... A63B 24/0021 473/140

* cited by examiner

*Primary Examiner* — Nini Legesse

(57) ABSTRACT

A practice device for hitting a golf ball (1) off a cushioned golf mat (16), whereby golf ball is connected to a swing arm apparatus (1-12) attached to a structure (17) at a fixed height above ground, whereby swing arm apparatus will rotate about axis (9) after golf ball is hit. Structure (17) is attached to a mat platform (19) secured to ground when outdoors, or secured to extension of platform golfer stands on if indoors. An upper stopper (14) prevents the swing arm apparatus from going past a vertical orientation after ball is struck. A lower stopper (15) stops the ball on way back down after being hit, and supports swing arm apparatus at resting position with ball just touching cushioned golf mat. A flexible stick (20) is attached to structure visually informing golfer when club strikes the cushioned golf mat prior to striking golf ball.

12 Claims, 7 Drawing Sheets

PRACTICE DEVICE FOR HITTING GOLF BALLS OFF GROUND

CROSS-REFERENCE TO RELATED APPLICATIONS

This application claims the benefit of U.S. Provisional Patent Application Ser. Nos. 62/061,509 and 62/061,519 filed on Oct. 8, 2014, filed by the present inventor.

FEDERALLY SPONSORED RESEARCH

Not applicable

SEQUENCE LISTING OR PROGRAM

Not applicable

BACKGROUND

Prior Art

There exists a variety of prior art for golf swing practice devices that offer golfers an opportunity to practice hitting a golf ball tethered to a small portable structure. The practice can be performed indoors or outdoors, in a space just big enough to swing a golf club. In theory, it is a convenient product to have when a golfer is only interested in practicing, since all the time it takes traveling to and from the driving range can be avoided and replaced by the practice itself, and within seconds of deciding to do so.

A device that for many years has been widely available on the market is based on U.S. Pat. No. 2,929,632 to Moffatt (1960). The device employs the use of a structure shaped like an upside down L, with a practice golf ball hanging above the ground attached by a nylon cord to the tip of the inverted L structure. When the ball, which is hollow and considerably lighter than a standard golf ball, is hit forcefully, it rotates about the tip of the structure for a few revolutions, until the energy from the hit dissipates, then continues to move in a pendulum fashion for some time until it finally comes to rest; however, since the ball used is much lighter than a standard golf ball, it does not provide adequate feedback through the hands. The problem for me was that it transmitted the same feeling through the hands for good hits, in the center of the face of the club, as it did for bad hits off center. But the Moffatt design has a built in problem that is very difficult to solve: when a standard golf ball, of considerably heavier weight, is affixed to a freely rotating cord, the heavier golf ball comes off the driver in a ballistic-like fashion at a very high speed, and rotating about the inverted-L structure a multitude of revolutions per second. It is very difficult to create a safe cord attachment, that also feels safe, because the ball can feel like it could break off when it is heading in your direction during each revolution. Additionally, a heavier ball results in a greater number of revolutions, and would therefore result in more time spent waiting for the ball to come to rest.

Subsequently, newer devices have been designed to stop the ball sooner. Shieh (1997) discloses a rigid connection of a "dummy ball" to an inverted-L structure, with a helical spring for counteracting the force applied on the ball by the hit. However, there is no mention of the method used for stopping the returning ball, which without any means to stop it, will result in an unspecified amount of pendulum-like travel past the resting position of the ball. In addition, the term "dummy ball" is not defined any further, and therefore not specified to be of regulation weight. Moreover, based on personal experience from the prototyping phase of my device, if a regulation weight golf ball is used with a rigid connection of the ball to the structure, as Shieh device proposes to avoid entanglement and breakage, an ample amount of pain will soon be felt after a plurality of full swing hits with the either driver, fairway woods, and long irons. The extra amount of inertia coupled with lack of "give" will be transmitted to the hands, and be felt in the form of pain after a plurality of hits. Another problem arises with the design, since the ball is situated directly below, and towards the center of the horizontal structure, the view of the golf ball is blocked when using the shorter clubs, such as a pitching wedge, due the outer portion of the horizontal structure being in the line of sight of the golf ball.

U.S. Pat. No. 7,070,520 to An (2006) discloses a mechanism with a spring attached to a pivoting arm that is affixed to the ball, which stops the ball more rapidly than a freely rotating cord. However, as seen in the An prior art, FIG. 4, the arm (34) only pivots away from stationary position after the ball is hit, and does not stretch or lengthen, with the spring. The spring only provides a dampening effect, once the arm has pivoted away, helping the arm become stationary quickly. The length of the arm from the pivot point to the ball does not increase in length in order to absorb the energy of a forceful hit, which will cause pain in the golfer's hands after a number of hits. Additionally, the ball is to be positioned at a proper "Tee" height, therefore it does not provide feedback for improvement during strokes taken where the ball rests on the ground.

U.S. Pat. No. 7,214,136 to Perry (2007) discloses an apparatus with a rotationally mounted golf ball, the movement of which is slowed by movement of a piston against a spring and through a liquid. The problems with this design begin with the use of a regular golf ball in combination with a shaft made of steel cable that connects it to the structure. The inertia of a regular golf ball coupled with the lack of flexibility in the suspension material used to attach the ball to the structure above it, will again result in pain in the hands of the golfer with the more forceful hits, since there is no flexibility in the steel cable. Especially since the design is for the driver, as the ball is designed to be at rest above ground. Another problem with the device is that the speed of a golf ball coming off a driver are far too high for a fluid to be used to dampen the rotational motion. The very forceful hit of an 80 mph driver, for example, pulling a piston inside a fluid will not be a gradual slowing down but rather a sudden one.

U.S. Pat. No. 8,801,528 to Dras (2014) is a device that uses a regulation golf ball to give the golfer a proper amount of feel, and a flexible cord to solve the pain problem, but a number of issues remain. The first being similar in nature to the Shieh line of sight problem. The Dras device employs the use of a stopping member of substantial horizontal orientation situated directly above the ball. Since the cord attaching the ball to the structure rotates about a fixed point, a golfer's inside-out and outside-in swings will produce a wide range of angles in the planes of rotation around the fixed point (see Moffatt FIG. 7), making for a necessarily wide stopper. Since the ball is situated directly below, and towards the center of the wide horizontal stopper structure, it will also block the view of the golf ball when the golfer uses the shorter clubs such as 8 iron, 9 iron, and the wedges. Other problems I noticed include: the 4 to 7 seconds it takes for golf ball to come to rest, which is not sufficiently close to the one second return to resting position that I would prefer; Another problem I encountered is that the ground is not incorporated into the golfer's practice for shots where the ball lies on the ground, because the device always puts the bottom of the ball a sufficient height above the ground owing to the unraveled cord. This is because the device is specifically designed for the driver, since the cord is the means for the ball " . . . to always return to a driving position after the hit . . . ".

U.S. Patent Application 2004/0063509 by Shioda uses a hitting target that is substantially the same as a softball, 3.8 inches in diameter, versus 1.68 diameter of a golf ball. The surface area of the softball is much larger and does not provide as accurate a determination as to whether the center of the face of the golf club was hit. Furthermore, the shaft of a golf club fits inside the "hosel" of the head of the golf club, which is in front of the face of the club, the face is that part which makes contact with golf ball, and therefore the hosel will hit the softball prior to hitting the center of the face of the club since the ball is too large. In other words, the center of the softball cannot align with the center of the face of the club without hitting the hosel first. In the second embodiment, a softball sized member to be hit is attached to a spring, FIGS. 9 and 10, and is designed for "providing sufficient resistance to the impact of the golf club to impose muscular strain on the golfer for muscle development," thereby making the device unusable for full swings of the golf club, as any resistance, and much less an excess of resistance for muscle development, would cause pain and or injury after the first full swing hit.

There exists another area of prior art related to improving a golfer's swing. There are devices that are positioned outside the correct path of a golf club and provide feedback to the golfer during a stroke, whether it be with a putter, a driver, or any club in between. These devices allow a golfer to practice their stroke while avoiding contact with the device. If a golfer executes a swing that goes outside the proper path, the various devices make contact with the club in a multitude of ways, thereby informing the golfer of their mistake by feeling the contact through the hands, seeing the movement of the device after being hit, or both.

A sampling of these devices includes U.S. Pat. No. 5,513,842 issued to Wateska et al. (1996), where a series of pendulums are suspended above the head of a club, and can be adjusted to closely follow any shape outline depending on the club head. Downing (1998), and Levy (2012) are also examples of prior art that provide a guide positioned above the club head for informing the golfer of a swing path that is above the intended path.

The prior art Levy (2012) device is specifically designed "to train golfers how to drive a golf ball by getting under the ball." The word "drive" specifies that the club used with the device is a driver, and the golf balls shown in the diagrams are depicted on a tee. My invention is designed for training golfers for all the other clubs except the driver, and specifically golf balls that are not on a tee. The goal of the Levy device is to train a golfer to get lower, as opposed to my invention which trains a golfer to get above a precise height. Another difference is the Levy device trains the golfer for a horizontal plane swing path as the club strikes the golf ball, the present invention trains the golfer to hit the golf ball with varying amounts a vertical component in the path of the club, depending on the club. With the exception of the putter, all the other clubs used for present invention, the path of the golf club should not be horizontal, since taking a divot, or hitting the ground after hitting the golf ball is the desired result. Although the device is clearly for different purposes than the present invention, the Levy design has similarities which I will attempt to differentiate from mine. The first, is the present invention allows the flexible stick to be positioned at various distances away from the fixed golf ball. Different clubs require different distances, depending on the angle of attack, or vertical component, desired. For example, a 3-wood requires the closest to a horizontal path approaching the ball, therefore the flexible stick needs to be placed further away, about 2 inches from the golf ball. Whereas the more lofted clubs, a pitching wedge for instance, a steeper angle of attack is desired and therefore the flexible stick is placed only an inch away from the golf ball. These modifications are easily made by loosening a knob, rotating the flexible stick to desired distance away from golf ball, then tightening the knob. Another important feature making the present invention being of superior design, is the lack of bumpers to dampen the flexible stick from moving back and forth horizontally. The flexible stick needs to continue its movement for as long as possible so as to be seen by the golfer. It is very easy to miss the movement due to blinking, or the rotation of the body going past the golf ball thereby rotating the head along with it, and also the tendency to want to follow the flight of the ball with our eyes. The flexible stick, being made of a very flexible material, while anchored at one end with nothing to restrict its movements provides a larger range of motion with accompanying longer duration.

Another sampling of prior art, including U.S. patents issued to McCormick (1997), Coombs (2007), Dahl (2009), and Hensel (2011), exemplify devices that are positioned horizontally adjacent to the club head, wherein the device is positioned either outside the correct swing path, near the toe of the club head, or inside near the heel, to provide feedback to the golfer when the swing path strays too far inside or outside the correct swing path.

Of those devices mentioned, the Hensel (8/16/2011) device additionally informs the golfer of a swing path that is below the intended path, albeit with a variety of deficiencies. This is an area where my device attempts to provide the best feedback, but first some background is needed. Many golfers practice at driving ranges where the golf balls are hit off artificial grass mats made of nylon, instead of natural grass. But hitting a golf ball sitting directly on a golf mat can give the golfer the false sense of security that they are striking it correctly because the mat allows the club to slide across its surface without much friction being felt by the golfer, nor a slowing down of the club head which would adversely affect the shot. A golf swing that contacts a golf mat surface slightly prior to striking the ball, can feel sufficiently similar to the well hit shot that strikes the ball first and the mat second, therefore the golfer does not get enough feedback to avoid repeating the mistake. When a golf ball is hit off natural grass, and the club makes contact with the ground slightly prior to hitting the ball, the club head digs in through the grass and into the soil, slowing the club down dramatically, resulting in an undesirable shot that travels a fraction of the intended distance.

The Hensel (2011) device functions as a placeholder for the golf ball position prior to a strike off natural grass. The golf ball is placed between two arrows on each side of the device, after the ball is hit and a divot is taken, the golfer can observe the divot taken in relation to the arrows on the device lining up with where the golf ball had been. Information regarding the divot entry point, length of divot and the exit point are compared to the ball position markers on the device after a divot is taken. The first issue I found with the Hensel device is that since the natural grass that the golf ball was resting on prior to the hit has been destroyed with the divot, the device must be moved after each hit. If tees are placed in the holes provided to secure the device to the ground, then you have a time-consuming task to perform every time you take a divot, and taking a divot is the intended result of every swing. If tees are not used to secure the device to the ground, and slight contact is made with the device, the golf ball position is lost as well as the information to be gleaned from the divot. Additionally, if the device is hit with a full swing by the golfer, the device will fly into the range area, whereupon you have to ask the other golfers to pause their practice while the device is retrieved. Furthermore the device is not designed for use at a driving range with mats, because the club makes no discernable marks on a golf mat.

SUMMARY

One embodiment of the practice device comprises a golf ball resting on a cushioned golf mat, with the golf ball attached to one end of a stretchable swing arm apparatus, while the swing arm apparatus is attached to a structure at a fixed height above the ground, whereby when the golf ball is hit, the swing arm apparatus travels around an axle mounted to the structure until it contacts an upper stopper attached to the structure, whereby the swing arm apparatus falls back in the opposite direction until contact is made with a bottom stopper, and returning the golf ball to same resting position in approximately one second of time. The lowest extremity of the structure and cushioned golf mat are attached to a platform which is secured to ground if outdoors, or extended if indoors allowing golfer to stand on it thereby preventing its movement after ball is hit. A flexible stick is affixed to the structure, and placed slightly below the swing path of the club head as it approaches the golf ball, whereby if the golfer's swing plane is below ideal, the flexible stick will get bit and move rapidly a few times back and forth, and thereby inform the golfer of the lower than desired swing path.

Advantages

A number of advantages of present invention become evident if we consider that during a round of golf, the 18 tee shots that begin play for each hole are the only times the golf ball can be placed on a tee, and thereby create room for error in the swing path of the club head between the ground and the ball. All other strokes must be played as the golf ball lies on the ground after coming to rest. When hitting a golf ball off the ground, excluding putting, it is highly desirable for the bottom edge of the club head not hit the ground until after the club face makes center-face contact with the ball. Beyond that point, the club can dig into the ground. That is something that requires a great deal of precision at the bottom of the golfer's swing arc in order to accomplish. I have noticed that chipping and pitching seem to require an even higher degree of accuracy at the bottom of the swing plane as the club gets very close to the golf ball, since the club is traveling at a much slower speed, it cannot overpower contact with heavy grass or the ground before striking the ball. When putting, all contact with the ground must be avoided.

The advantages my device provide allow for a golfer to develop the skill required for making contact with any golf shot where the golf ball lies directly on the ground, or very close to the ground, such as on par three tee shots, or short par 4 tee shots where driver may not be used, and therefore a tall tee will not be employed.

(a) Practice to improve ball-striking skills for 13 out of the 14 clubs, since all clubs other than driver are used for hitting the golf ball off the ground.

(b) The device uses a regular golf ball that is used for play. It is heavier than the practice balls used on prior art devices. The heavier real golf ball provides feel to the golfer's hands. Good shots will feel good through the hands and arms, and bad shots, those hit off-center of club face will deflect the club and the resulting twisting will provide unpleasant feedback through the hands. The balls that are a fraction of the weight of a regular ball do not provide this feedback, as the hits that are off-center club face, feel the same as those hit accurately in the center of club face.

(c) The golf ball returns to original resting position in one second, resulting in rapid improvement since it allows the golfer to make small corrections based on the previous swing, without having to change stance nor grip before hitting the ball again.

(d) The Flexible Stick will visually inform golfer with brief rapid movement back and forth when the cushioned golf mat is struck prior to the golf ball. Hitting the ground prior to the ball is an undesirable result. Allows a golfer to practice what is called "ball striking", a very desirable skill to play golf well.

(e) Another advantage, in regards to the design of the device, the rigid structural components allows for the golf ball to be positioned forward of all structural components resulting in a clear view of the golf ball, FIG. 6, for the golfer at address and prepared to hit ball.

DRAWINGS

Figure 7:
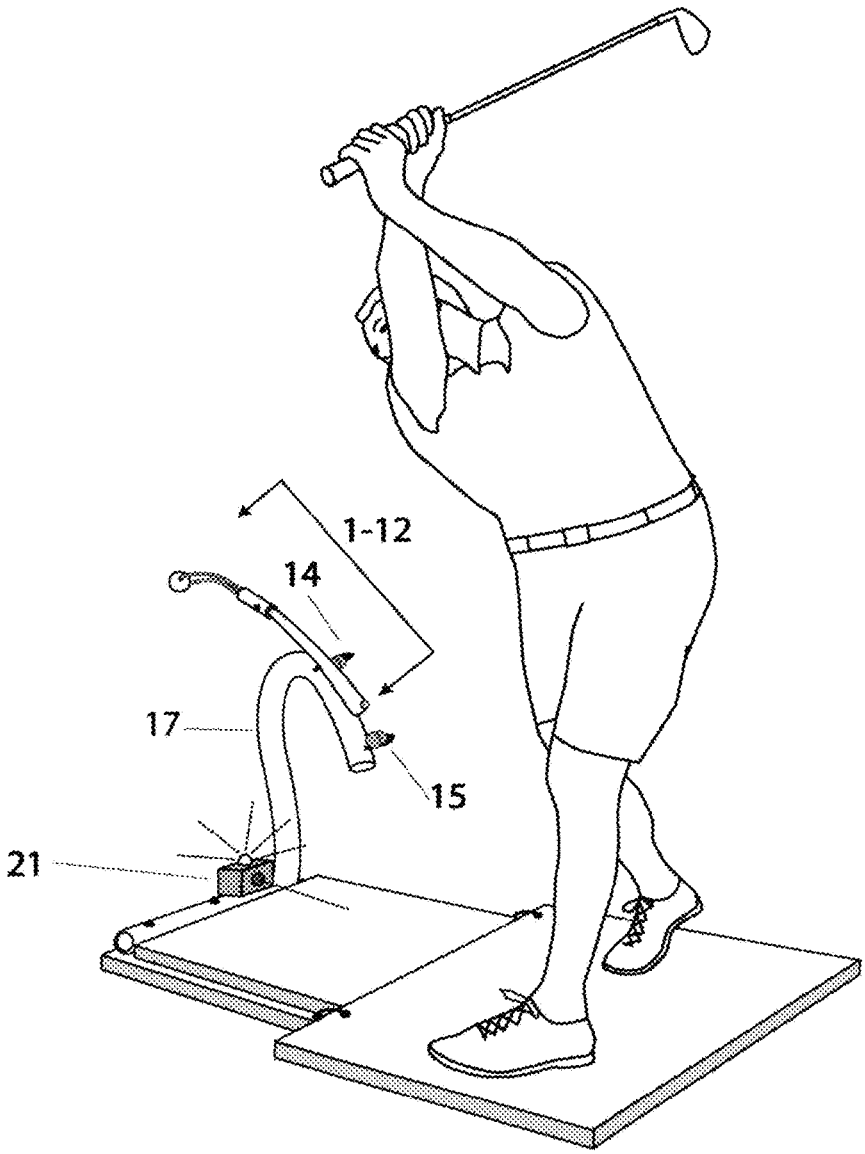

FIG. 7 Illustrates a custom molded prefabricated piece for the swing arm apparatus {1-12}. The structure (17) consists of a one piece prefabricated PVC pipe. The hex bolt upper stopper (14) and hex bolt lower stopper (15) are replaced by custom fabricated components attached directly onto the structure without employing a housing. In this embodiment, an infrared sensor with audible sound is used to inform the golfer of a lower than ideal swing path when the golfer strikes the cushioned golf mat prior to the golf ball, an undesirable result.

DRAWINGS

Reference Numerals

1 golf ball
2 hole through golf ball
3 trimmer line
4 clear vinyl tube
5 first ferrule
6 rubber tube
7 first mechanical screw & wing nut
8 rigid cylinder
9 first hex bolt axle
  9*a*. second hex bolt support
10 extension spring

11 second mechanical screw guide
12 slot
{1-12} swing arm apparatus
13 housing
14 hex bolt upper stopper
15 hex bolt lower stopper
16 cushioned golf mat
17 structure
18 carriage bolts & knobs
19 mat platform
20 flexible stick and second ferrule
21 infrared sensor with audible sound

DETAILED DESCRIPTION

Figure 1:
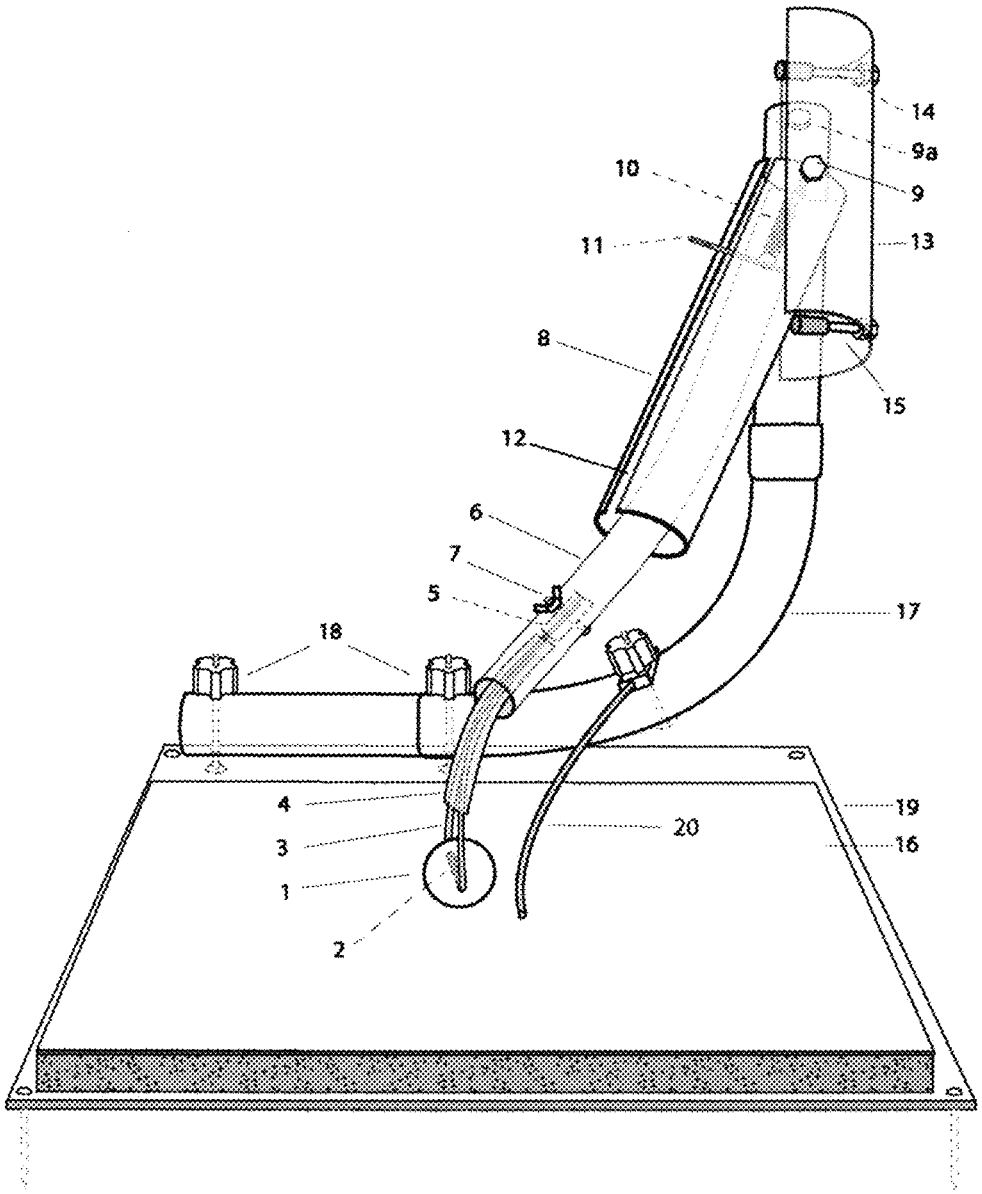
FIG. 1 Shows one embodiment of device in side view.
Figure 2:
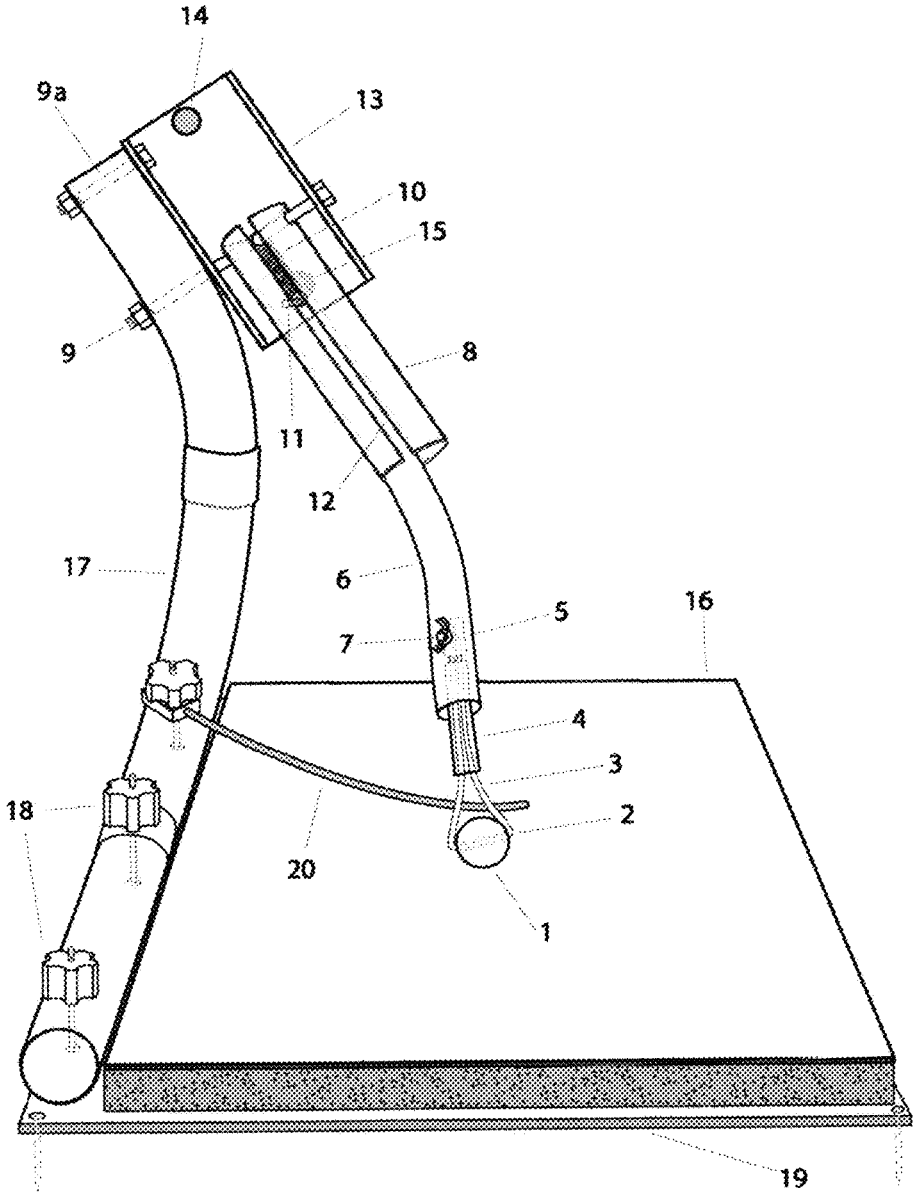
FIG. 2 Shows one embodiment of device in front view.
Figure 3:
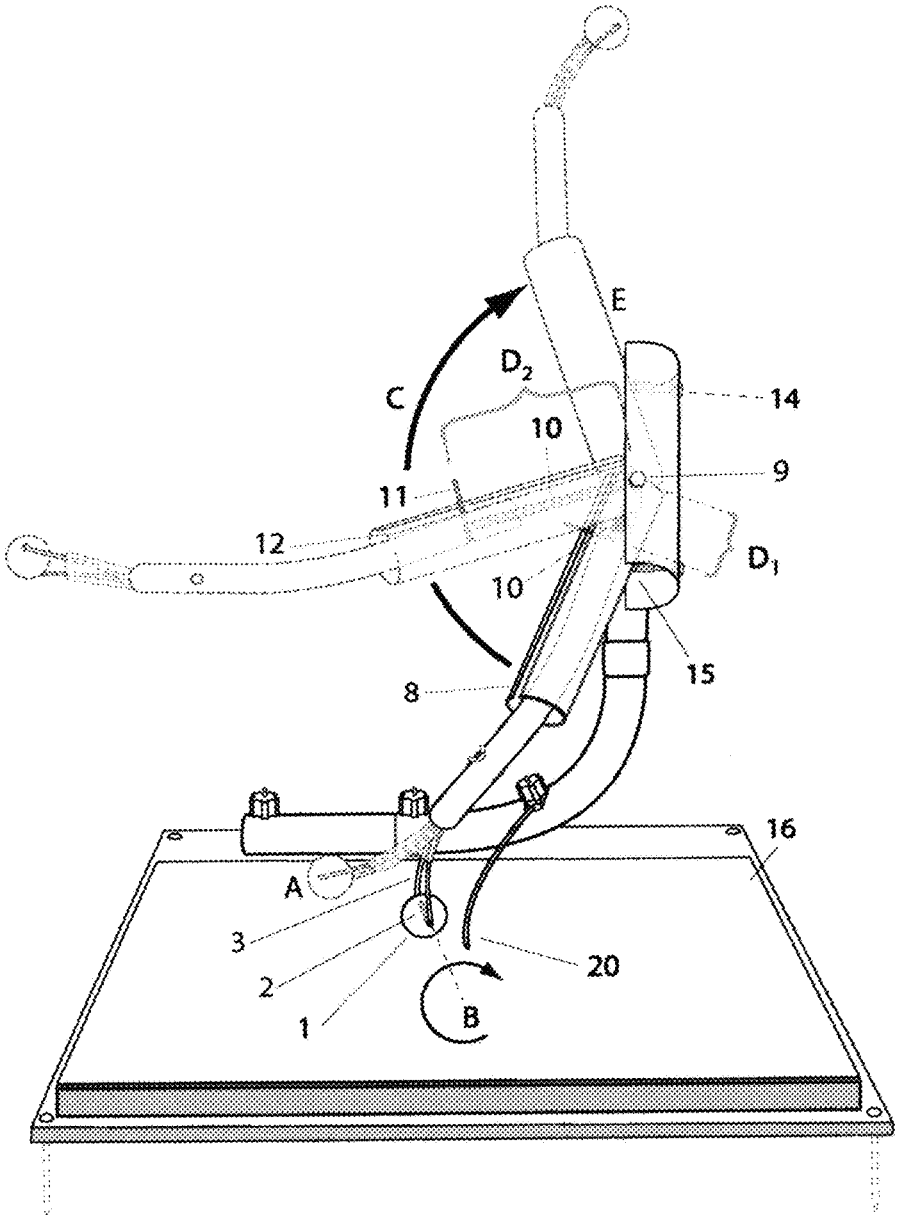
FIG. 3 Depicts operation of device in side view.
Figure 4:
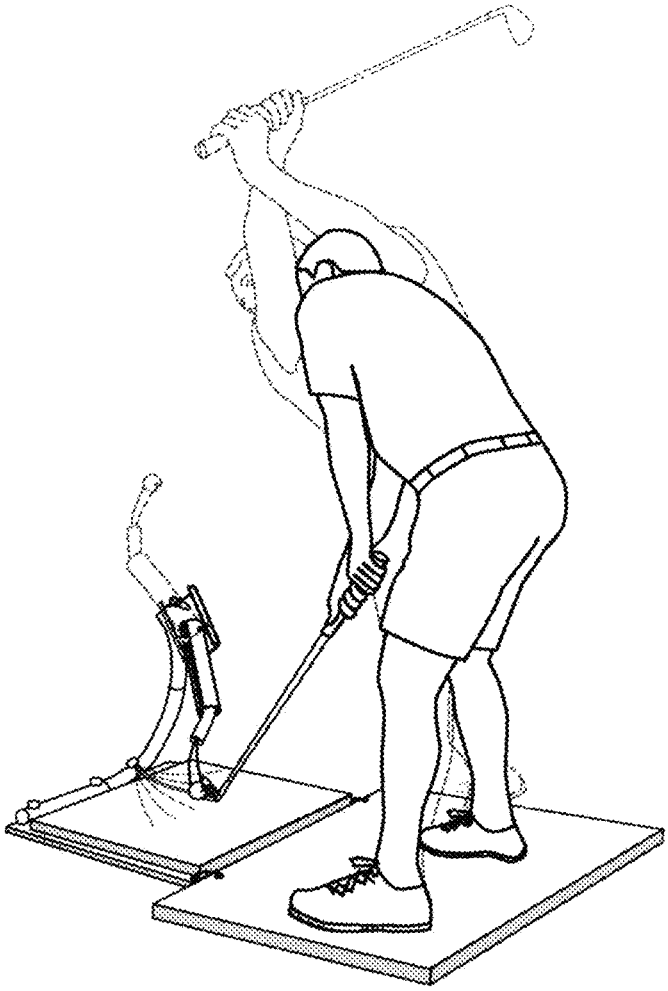
FIG. 4 Illustrates a golfer using one embodiment configured for indoor use, where the golfer stands on a platform attached to the device thereby holding it place after each hit of the ball.

FIGS. 1, 2, 3—First Embodiment

One embodiment of the device is illustrated in FIG. 1, FIG. 2, and FIG. 3. We begin with a standard regulation golf ball 1, as defined by one sufficiently similar to those used for play in PGA Tour events, and thereby has satisfactory characteristics of stiffness, compression when hit sufficiently hard, and resilience to rapidly return to original resting characteristics. A hole through golf ball 2 is drilled through the diameter, and where the hole will be situated to generally coincide with the rotational axis of the golf ball after being hit FIG. 3 (B). Made from an extremely durable plastic, a trimmer line 3 is threaded precisely half way in the hole through golf ball. In one embodiment, the strongest trimmer line I found is a 0.155" (3.9 mm) of "Best" durability by Jarden Applied Materials, Columbia, S.C. However, the trimmer line can consist of any other material that can withstand the forces applied repeatedly by full swings of a 3 wood to the golf ball, without fracturing prior to the golf ball fracturing.

The ends of the trimmer line are inserted into a clear vinyl tube 4, ensuring trimmer lines extend beyond the end of the clear vinyl tube, where the two ends of are inserted fully inside a first ferrule 5, which is then hit with a hammer a sufficient number of times to crimp the trimmer lines to the first ferrule. A hole is drilled perpendicularly through the first ferrule. Then inserted inside one end of a rubber tube 6, making sure the curve bias of the trimmer line curves downward, while the curve bias of the rubber tube curves upwards. This allows the golf ball to hang vertically keeping the trimmer line clear of the path of the golf club.

A first hole is drilled perpendicularly through the rubber tube, where a first mechanical screw 7 and wing nut are used to secure the first ferrule inside the rubber tube.

On the unaltered end of the rubber tube, a second hole is drilled perpendicularly through the rubber tube. An extension spring 10, is inserted into the rubber tube where a a second mechanical screw guide 11, is passed through a second hole in walls of the rubber tube while ensuring to catch the hook of the extension spring. The remaining hook of the extension spring remains outside the rubber tube.

In this embodiment a rigid cylinder 8, comprises a first PVC pipe of 2" diameter and 9" in length. A slot 12 that is sufficiently wider than the second mechanical screw guide, is cut out of rigid cylinder along its entire longitudinal length. A hole wide enough for a first hex bolt axle 9 to pass through is drilled perpendicularly through the diameter of the rigid cylinder nearest possible to one end, leaving two holes, equidistant to the slot. The rubber tube is then inserted into the rigid cylinder making sure the second mechanical screw guide 11, being sufficiently long to remain outside diameter of the rigid cylinder, is placed inside the slot 12 cut out of the rigid cylinder. The two components together can travel freely in linear opposite directions to one another. This results in eliminating unwanted rotational travel of the rubber tube inside the rigid cylinder thereby helping return the golf ball to the same resting position every time. The outside hook of extension spring 10 is aligned with the two holes of the rigid cylinder, then first hex bolt axle 9 is passed through all three, thereby serving as the axis of rotation for the swing arm apparatus {1-12}.

Figure 6:
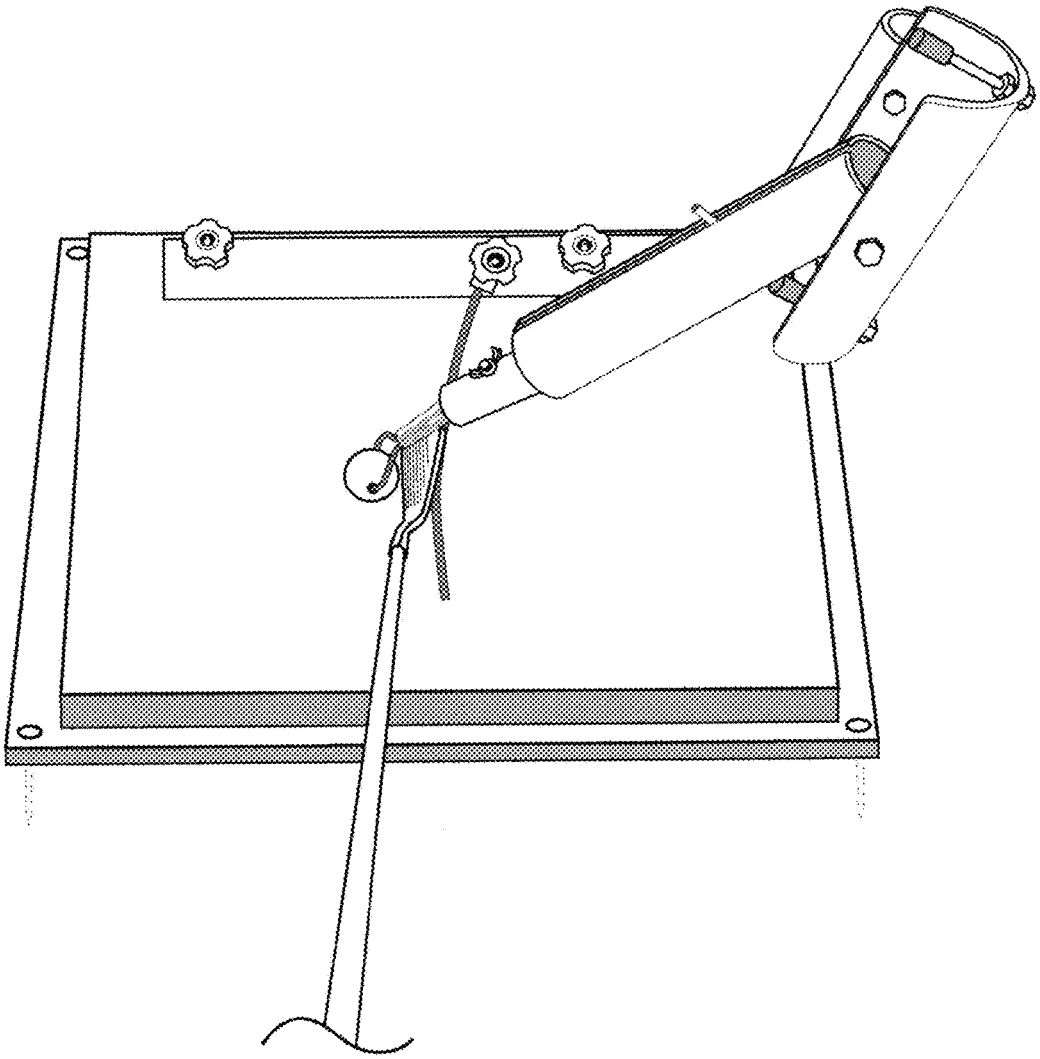
FIG. 6 Shows a clear line of sight to the golf ball from the perspective of the golfer standing at address, prepared to hit the golf ball.

For this particular embodiment, the structure 17 comprises three sections of PVC pipe held together with PVC cement. One section is a 45 degree elbow with holes drilled near top portion for first hex bolt axle 9, and second hex bolt support 9*a*, to pass through. A 90 degree elbow is inserted into the flare end of the 45 degree elbow, and secured with PVC cement. Serving as the base of the structure, a straight length PVC pipe is inserted into the flare end of the 90 degree elbow, and secured with PVC cement. The angle for first hex bolt axle 9, FIG. 2 is closer to horizontal than vertical, the angle helping to keep components that are above the golf ball from blocking the line-of-sight to the golf ball, FIG. 6. The structure is attached to the mat platform 19, with carriage bolts & knobs 18, consisting of two carriage bolts, two lock washers, and two multiple lobe knobs.

A housing 13 is created by cutting in half longitudinally, a second PVC pipe twice the diameter of the rigid cylinder, of which only one of the two halves is used. Two holes are drilled through the remaining half, disposed opposite each other at the mid point nearest possible to the longitudinal edges where the second PVC pipe was cut. First hex bolt axle 9, passes through the holes in the housing, both holes in rigid cylinder, and the outside hook of the extension spring. Furthermore, first hex bolt axle passes through top portion of the structure 17 and secured with lock washer and hex nut, whereby a second hex bolt support 9*a*, with lock washer and hex nut, is used to help secure one side of the housing to the top most portion of the structure.

A hex bolt upper stopper 14 is attached to housing by drilling a hole in the housing disposed centrally and nearest possible to center, and nearest the top as possible. Two lock nuts are used on either side of the housing to secure the hex bolt upper stopper 14, and finally a rubber furniture leg tip is pushed onto the hex end of the bolt creating a soft point of contact to the swing arm apparatus.

A hex bolt lower stopper 15 is attached to the housing by drilling a hole in the housing disposed centrally, and nearest the bottom as possible. Two lock nuts are used on either side of the housing to secure the hex bolt lower stopper 15, and another rubber furniture leg tip is pushed onto the hex end of the bolt creating a soft point of contact to the swing arm apparatus at resting position.

In this embodiment the flexible stick 20 is a weed trimmer line that is taken from stock that is not coiled, whereby the trimmer line is sufficiently straight, is thereby inserted into a second ferrule and crimped together by smashing it with a hammer a sufficient number of times, then a hole is drilled through the second ferrule, whereby it is secured to the structure with a carriage bolt and a lobe knob.

A durable woven nylon turf with foam backing, is placed on top of a 1" thick mattress foam, of slightly less area than the nylon turf, creating the cushioned golf mat 16. Both are stapled in place to the mat platform 19.

For use outdoors, the mat platform has four holes near each corner for four spikes to pass through to secure the mat platform to the soil. For use indoors, the mat platform is held in place with durable nylon cable ties through the two holes on the side of the golfer where they can be attached to a second mat of sufficient size and strength whereby the golfer standing on it will keep the mat platform in place after each strike of the golf ball.

Figure 5:
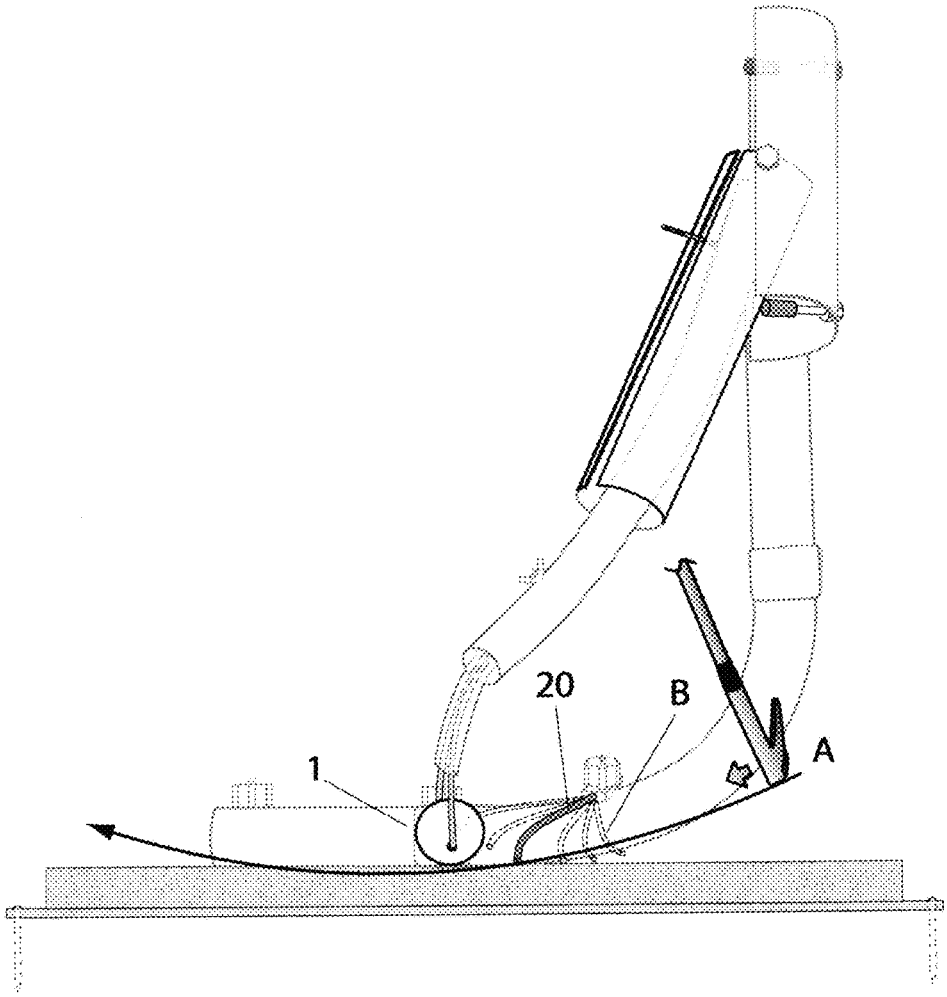
FIG. 5 Depicts operation of flexible stick in side view.

Operation FIGS. 3, 5

The softest hit a golfer can execute, whereby the golf ball minimally bounces off the clubface, FIG. 3 (A), the trimmer line 3 will flex in the direction of the hit while providing little, to no discernable resistance felt through the golfer's hands.

When a slightly more forceful hit is imparted by the golfer, in addition to the flexibility of the trimmer line, the rigid cylinder 8 freely rotates about hex bolt axle 9, FIG. 3(C).

The situation whereby the most forceful hit is given by a full swing of a golf club, and a center-face hit is achieved, the golf ball will compress and stay on clubface a fraction of a second longer. While the golf ball remains compressed against the face of the club and before the ball has a chance to rebound, the golf club will continue to move forward, at which point extension spring 10 will stretch out, while the golf ball is in contact with the face of the golf club.

FIG. 3 ($D_1$), shows extension spring 10 at rest, FIG. 3 ($D_2$) depicts the extension spring 10 after a forceful hit of the ball. Second mechanical screw guide 11 rides inside slot 12, thereby keeping the rubber tube 6 from rotating inside rigid cylinder 8. Thus the rubber tube's movement is limited to only a linear direction outwardly when hit, and also linearly back in when extension spring returns to resting position. In this embodiment, the extension spring which works sufficiently well is made by Hillman Group with dimensions ⅝"×3"×0.072".

The spin rate of a golf ball that is struck well, reaches into the several thousands of revolutions per minute. The orientation of the hole through golf ball 2 is aligned with the golf ball's spin axis resulting from being struck, whereby given that the diameter of trimmer line 3 is narrower than the diameter of hole 2, some spinning of the ball will occur FIG. 3 (B). The rotation allows the golf ball to get hit in random places around its circumference thereby stretching the life of the golf ball.

If the hit on the golf ball is forceful enough, the freely rotating swing arm apparatus {1-12} moves upward around hex bolt axle 9, where all remaining energy is absorbed by the collision of rigid cylinder 8 with hex bolt upper stopper 14, FIG. 3 (E). The swing arm apparatus will then fall, by the force of gravity alone, towards its resting position, where the rigid cylinder comes in contact again with the hex bolt lower stopper 15.

If the golfer's swing path is too low, FIG. 5 (A), the bottom edge of the golf club will strike flexible stick 20 causing it to move back and forth several times prior to stopping. Thus visually informing the golfer that the ground was struck prior to the golf ball.

Alternative Embodiment

FIG. 7

This particular embodiment illustrates a custom molded prefabricated piece for the swing arm apparatus (1-12). The upper stopper (14) and lower stopper (15) are attached directly to the structure (17), without employing a housing.

Also illustrated yet another method of informing the golfer the swing path was below intended path with a precisely oriented infrared sensor that triggers an audible sound when the club head crosses its path (21).

I claim:

1. A golf practice device comprising:

a. a golf ball sufficiently similar to those used for playing golf, b. a first element for attachment of said golf ball to a trimmer line, c. a second element for attachment keeping both strands of said trimmer line close together, d. a third element for attachment of said trimmer line to a rubber tube, e. an extension spring, f. a fourth element for attachment of said extension spring to said rubber tube, g. a rigid cylinder loosely encompassing approximately top half of said rubber tube, h. a fifth element for restricting movement between said rubber tube and said rigid cylinder, in only a linear direction with respect to one another, i. a cushioned golf mat, on which said golf ball will rest between hits, j. a mat platform positioned underneath said cushioned golf mat, k. a sixth element for attachment of said cushioned golf mat to said mat platform, l. a structure composed of a plurality of PVC pipes cemented together, m. a seventh element for attachment of said structure to said mat platform, n. a housing consisting of a half-pipe cut from a PVC pipe, of sufficiently larger diameter, and of approximately the same length, as said rigid cylinder, o. an eighth element for attachment of said housing, said rigid cylinder and said extension spring to said structure, p. a ninth element for attachment to said housing for support of said rigid cylinder while said golf ball is at rest, q. a tenth element for attachment to said housing for stopping, prior to reaching a vertical orientation, said rigid cylinder rotating about said hex bolt axle after said golf ball is hit, r. a flexible stick of sufficient durable properties capable of withstanding repeated direct hits by full swings of a golf club, s. an eleventh element for attachment of said flexible stick to said structure, adjustably adjacent to said golf ball.

2. The golf practice device of claim 1 wherein said first element for attachment is a hole through said golf ball whereby said trimmer line is passed half way through.

3. The golf practice device of claim 1, wherein said second element for attachment is a clear vinyl tube keeping the two ends of said trimmer line together.

4. The golf practice device of claim 1 wherein said third element for attachment is a first ferrule used to crimp together the two ends of said trimmer line, whereby a hole is drilled through said first ferrule and inserted into one end of said rubber tube, whereby a first mechanical screw and wing nut are used to secure said first ferrule to said rubber tube.

5. The golf practice device of claim 1, wherein said fourth element for attachment whereby said extension spring is inserted into remaining unaltered end of said rubber tube, whereby a second mechanical screw guide is passed perpendicularly through the walls of said rubber tube while catching one loop of said extension spring inside said rubber tube, whereby other loop of said extension spring remains outside said rubber tube.

6. The golf practice device of claim 1, wherein said fifth element is a slot that is cut out of the entire length of said rigid cylinder, wherein said second mechanical screw guide protrudes through said slot sufficiently far enough outside circumference of said rigid cylinder, thereby ensuring said rubber tube can travel in only a linear direction along said slot of said rigid cylinder.

7. The golf practice device of claim 1, wherein said sixth element for attachment consists of stapling said cushioned golf mat to said mat platform.

8. The golf practice device of claim 1, wherein said seventh element for attachment are two carriage bolts and knobs used to secure said structure to said platform.

9. The golf practice device of claim 1, wherein said eighth element for attachment is hex bolt axle passed through holes in said housing, said rigid cylinder, protruding hook of said extension spring, and said structure and secured with a lock nut.

10. The golf practice device of claim 1, wherein said ninth element for attachment is a hex bolt lower stopper attached centrally and sufficiently near the bottom of said housing, thereby providing precise resting position for said rigid cylinder, whereby said golf ball is in contact with said cushioned golf mat.

11. The golf practice device of claim 1, wherein said tenth element for attachment is a hex bolt upper stopper attached centrally and sufficiently near the top of said housing, thereby stopping rotational travel of said rigid cylinder, prior to reaching vertical orientation, after said golf ball is hit.

12. The golf practice device of claim 1, wherein said eleventh element for attachment is a second ferrule crimped together to one end of said flexible stick, whereby said second ferrule is thereby bolted onto said structure with a carriage bolt and knob.

* * * * *